United States Patent [19]

Babler et al.

[11] Patent Number: 5,011,309

[45] Date of Patent: Apr. 30, 1991

[54] RIBBON DRIVE FOR LOW COST QUIET IMPACT PRINTER

[75] Inventors: Egon S. Babler, Northbrook; Alf J. Olsen, Elk Grove Village, both of Ill.

[73] Assignee: Xerox Corporation, Stamford, Conn.

[21] Appl. No.: 510,640

[22] Filed: Apr. 18, 1990

[51] Int. Cl.[5] ..... B41J 23/34

[52] U.S. Cl. ..... 400/184; 400/155; 400/225; 400/322

[58] Field of Search ..... 400/155, 154, 163.1, 400/184, 185, 191, 212, 225, 322

[56] References Cited

U.S. PATENT DOCUMENTS

| | | | |
|---|---|---|---|
| 1,261,751 | 4/1918 | Anderson . | |
| 3,986,594 | 10/1976 | Kondur, Jr. | 400/185 |
| 3,995,547 | 12/1976 | Shimodaira et al. | 400/184 |
| 4,239,400 | 12/1980 | Giolitti | 400/184 |
| 4,352,576 | 10/1982 | Hori et al. | 400/155 |
| 4,410,289 | 10/1983 | Koike et al. | 400/185 |
| 4,443,124 | 4/1984 | Ozawa | 400/225 |
| 4,449,835 | 5/1984 | Arai | 400/185 |
| 4,461,588 | 7/1984 | Watanabe et al. | 400/185 |
| 4,668,112 | 5/1987 | Gabor et al. | 400/157.3 |
| 4,681,469 | 7/1987 | Gabor | 400/157.2 |
| 4,698,567 | 10/1987 | Gottwald et al. | 400/225 |
| 4,758,108 | 7/1988 | Nanai et al. | 400/225 |
| 4,893,950 | 1/1990 | Ragen et al. | 400/185 |
| 4,902,148 | 2/1990 | Schmeykal et al. | 400/185 |

FOREIGN PATENT DOCUMENTS

| | | |
|---|---|---|
| 2919209 | 11/1980 | Fed. Rep. of Germany . |
| 2067472 | 7/1981 | United Kingdom . |

*Primary Examiner*—Eugene H. Eickholt
*Attorney, Agent, or Firm*—Serge Abend

[57] ABSTRACT

A serial impact printer comprising a support frame, a platen mounted for rotation upon the support frame, a print element having character imprinting portions disposed thereon, a print element selector for moving the print element to position a selected character imprinting portion at a printing position, a marking ribbon and a lift-off ribbon. A hammer for moving a selected character imprinting portion for deforming the platen with a printing force, and means for moving the hammer toward and away from the platen. Each ribbon is selectively positionable between the print element and the platen. A carriage mounted for reciprocating movement generally parallel to the platen supports thereon the print element, the print element selector, the marking and lift-off ribbons, means for positioning the ribbons, means for advancing the marking ribbon, the hammer, and the means for moving the hammer. A single D.C. motor comprises the means for moving the hammer, the means for positioning the ribbons, and the means for advancing the marking ribbon.

10 Claims, 9 Drawing Sheets

RIBBON DRIVE FOR LOW COST QUIET IMPACT PRINTER

FIELD OF THE INVENTION

This invention relates to an impact printer engine for use in low cost typewriters in which impact noise generation, during the printing operation, is substantially reduced. Cost is minimized by utilizing a single D.C. motor for driving the hammer and for positioning and advancing a marking ribbon and a lift-off ribbon.

BACKGROUND OF THE INVENTION

The office has, for many years, been a stressful environment due, in part, to the large number of objectionable noise generators, such as typewriters, high speed impact printers, paper shredders, and other office machinery. Where several such devices are placed together in a single room, the cumulative noise pollution may even be hazardous to the health and well being of its occupants. The situation is well recognized and has been addressed by governmental bodies who have set standards for maximum acceptable noise levels in office environments. Attempts have been made by office machinery designers, in the field of impact printers, to reduce the noise pollution. Some of these methods include enclosing impact printers in sound attenuating covers, designing impact printers in which the impact noise is reduced, and designing quieter printers based on non-impact technologies such as ink jet and thermal transfer.

The low cost personal typewriter is purchased primarily for home usage (including both personal and in-home office) and for school usage. It is particularly desirable in these environments to reduce the acoustic noise level of the printing mechanism at the source to levels which are unobtrusive. For example, in the home, other members of the family should not be distracted by the clatter of typing if conducted in common rooms. In a secondary school or college setting, colleagues and others should not be disturbed if the user types in a library, a study hall or a dormitory room. Heretofore such usage has not been possible because typewriters are notoriously noisy devices. The silent operation of our low cost quiet typewriter will enable such usage because silence transports such useful appliances into new physical settings and enhances portability. A derived benefit will be freer communication among work group members as the user is able to work directly in the group in a non-irritating manner.

The industrial typewriter market segment is at the high end of the product cost continuum, i.e. in the $1000 to $2000 range. Thus, the incremental increase in manufacturing costs necessitated by numerous design changes represents a relatively small percentage of the product cost which is passed on to the ultimate purchaser. At the opposite end of the product cost continuum, i.e. in the $150 to $300 range, there is the consumer, or commodity, market. Clearly, any modification necessitated by the implementation of a sound reduction design will of necessity be extremely low in cost because the incremental increase in product cost to the consumer will not warrant a large percentage rise in this market.

An explanation of noise measurement is appropriate to explain the following statements regarding noise abatement achieved by our invention. Noise measurements are often referenced as dBA values. The "A" scale, by which the sound values have been identified, represents humanly perceived levels of loudness as opposed to absolute values of sound intensity. When considering sound energy represented in dB (or dBA) units, it should be noted that the scale is logarithmic and that a 10 dB difference equals a factor 10, a 20 dB difference equals a factor of 100, a 30 dB equals a factor of 1000, and so on.

Typical typewriters generate impact noise in the range of 65 to just over 80 dBA. These sound levels are deemed to be intrusive. For example, the IBM Selectric ball unit generates about 78 dBA, while the Xerox Memorywriter generates about 68 dBA, and the low cost Smith Corona Correcting Portable generates about 70 dBA. When reduced to the high 50s dBA, the noise is construed to be objectionable or annoying. It would be highly desirable to reduce the impact noise to a value in the vicinity of 50 dBA. The low cost typewriter of the present invention has been typically measured at about 50 dBA. This represents a dramatic improvement on the order of about 100 times less sound pressure than present day low cost typewriters, a notable achievement toward a less stressful environment.

The major source of noise in the modern typewriter is produced as the hammer impacts and drives a character pad to form an impression on a receptor sheet. Character pads are carried upon and transported past a print station at the ends of the rotating spokes of a printwheel. When a selected character is to be printed, it is stopped at the print station and the hammer drives it against a ribbon, the receptor sheet and a supporting platen, with sufficient force to release ink from the ribbon onto the receptor sheet.

In conventional ballistic hammer impacting typewriters a hammer mass of about 2.5 grams is ballistically propelled by a solenoid actuated clapper toward the character/ribbon/paper/platen combination. After the hammer hits the rear surface of the character pad, its momentum continues to drive it toward and against the ribbon/paper/platen combination and to deform the platen surface. Once the platen has absorbed the hammer impact energy it seeks to restore its normal shape by driving the hammer back to its home position where it must be stopped, usually by another impact. This series of high speed impacts is the main source of the objectionable impact noise in these printers.

Typically the platen deformation impact is very short, on the order of 100 microseconds duration. Intuitively it is known that a sharp, rapid impact will be noisy and that a slow impact will be less noisy. Thus, if the impact duration were slowed it would be possible to make the device quiter. In low end typewriters with printing speeds in the 10 to 12 character per second range, the mean time available between character impacts is about 85 to 90 milliseconds. More of that available time can be used for the hammer impact than the usual 100 microseconds. If, for example, the platen deformation time were stretched to even 5 to 10 milliseconds this would represent a fifty to one hundred-fold increase, or stretch, in the impact pulse width. It is also intuitive that in order for a slow impact to deform the platen by the same amount, for releasing the ink from the ribbon, a larger hammer mass (or effective mass) must be used. This is because manipulation of the time domain of the deformation changes the frequency domain of the sound waves emanating therefrom, so that as the impulse deformation time is stretched, the sound frequency (actually a spectrum of sound frequencies) emanating from the deformation is proportionately reduced and the perceived noise output of the lower frequencies is reduced. Since this is a resonant system, the mass will be inversely proportional to the square of the frequency shift. Therefore, a one hundred-fold increase in the time domain (100 microseconds to 10 milliseconds) will proportionately reduce the frequency output when a ten thousand-fold increase in the mass is effected. Clearly it would not be practical to increase the actual mass of the hammer by such a factor. As an alternative to increasing the hammer mass per se, its effective mass may be increased by means of a mechanical transformer.

PRIOR ART AND RELATED PATENTS

The general concept implemented in the present typewriter, i.e. reduction of impulse noise achieved by stretching the deformation pulse and impacting with an increased hammer mass, has been recognized for many decades. As long ago as 1918, in U.S. Pat. No. 1,261,751 (Anderson) quieter operation of the printing function in a typewriter was proposed by increasing the "time actually used in making the impression". A type bar typewriter operating upon the principles described in this patent was commercially available at that time.

The quiet impact printing mechanism incorporating the theory of operation of the present invention is explained in the following two commonly assigned patents either one of whose disclosures is herein fully incorporated by reference. U.S. Pat. No. 4,681,469 (Gabor) relates to greatly increasing the effective mass of the hammer, introducing the hammer to the platen at a relatively slow speed and causing the platen deformation to take place over an extended period of time. In U.S. Pat. No. 4,668,112 (Gabor et al) it is taught to control the movement of the hammer from its home position to its application of impact force, whereby the hammer mass is moved toward the platen and will continue to move until an encounter with the platen is effected. As the hammer nears the surface of the platen its velocity is significantly diminished so that impact takes at a very slow speed. Subsequent to initiation of contact, the hammer force is increased to deform the platen.

In both the '469 and '112 patents a mass transformer, comprising a heavy rockable bail bar driven by a voice motor, urges a push rod toward and away from the platen in a controlled manner. The push rod in turn moves a print tip (hammer) into deforming contact with the platen. A sensor mounted upon the print tip indicates the moment of contact with the platen so that an additional application of kinetic energy may be provided by the voice coil motor at that juncture. By means of this arrangement a suitable controller, connected to the voice coil motor, motor the print tip across a throat distance between its home position and the surface of the platen in a controlled ballistic manner, i.e. the print tip is set in motion and will arrive at the platen surface regardless of its location ("self levelling"), and then controls the duration of the platen deformation with this high effective mass.

In U.S. Pat. No. 4,893,950 (Ragen et al) it is taught to use a common control member for maintaining the throat gap distance and for positioning the marking and lift-off ribbons. In German OLS 29 19 209 (Triumph Werke) there is taught a printwheel printer wherein a single motor 24 drives cams 19, 20 and 21. Cam 19 drives arm 3 which moves printwheel 1 vertically into a print position, and cams 20 and 21 selectively raise marking ribbon 10 or correcting ribbon 18 into the print position. In U.K. patent application no. 2,067,472 (Olivetti) there is taught a printwheel typewriter wherein an actuating motor 75 drives the hammer 49 as well as positioning and feeding marking ribbon 46 and possibly performing similar functions with respect to correction ribbon 48.

It is the primary object of the present invention to provide a very low cost quiet impact printer wherein a large effective mass acts to deform the platen over an extended contact period. After contact has been sensed, a further application of kinetic energy is effected. Low cost is maintained by using a single D.C. motor for driving the hammer and for marking or correcting by positioning an ink ribbon or a lift-off ribbon at the printing position and advancing the selected ribbon.

SUMMARY OF THE INVENTION

The present invention may be carried out, in one form, by providing a serial impact printer comprising a support frame, a platen mounted for rotation upon the support frame, a print element having character imprinting portions disposed thereon, a print element selector for moving the print element to position a selected character imprinting portion at a printing position, a marking ribbon and a lift-off ribbon. a hammer for moving a selected character imprinting portion for deforming the platen with a printing force, and means for moving the hammer toward and away from the platen. Each ribbon is selectively positionable between the print element and the platen.

A carriage mounted for reciprocating movement generally parallel to the platen supports thereon the print element, the print element selector, the marking and lift-off ribbons, means for positioning the ribbons, means for advancing each ribbon, the hammer, and the means for moving the hammer. A single D.C. motor comprises the means for moving the hammer, the means for positioning the ribbons, and the means for advancing the ribbons. The motor drives the hammer in both clockwise and in counterclockwise directions of rotation from a home position, it positions and drives the means for advancing the marking ribbon in only one direction of rotation from the home position, and it positions and drives the lift-off ribbon in only the opposite direction of rotation from the home position.

BRIEF DESCRIPTION OF THE DRAWINGS

Other objects and further features and advantages of this invention will be apparent from the following, more particular, description considered together with the accompanying drawings, wherein.

DETAILED DESCRIPTION OF THE ILLUSTRATED EMBODIMENT

Figure 1:
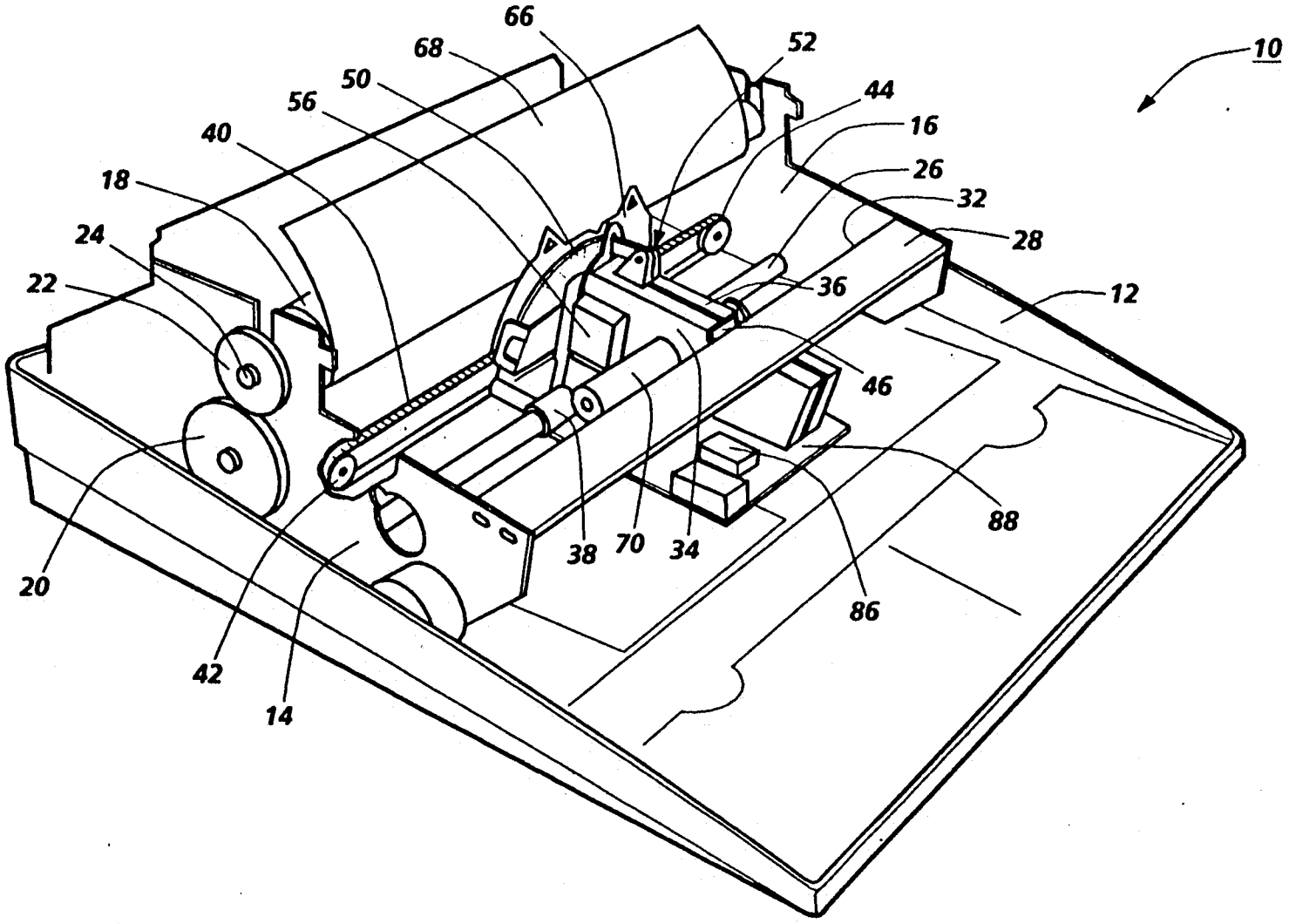
FIG. 1 is a perspective view schematically showing the carriage the reaction bar and other relevant features of a low cost quiet impact typewriter.
Figure 2:
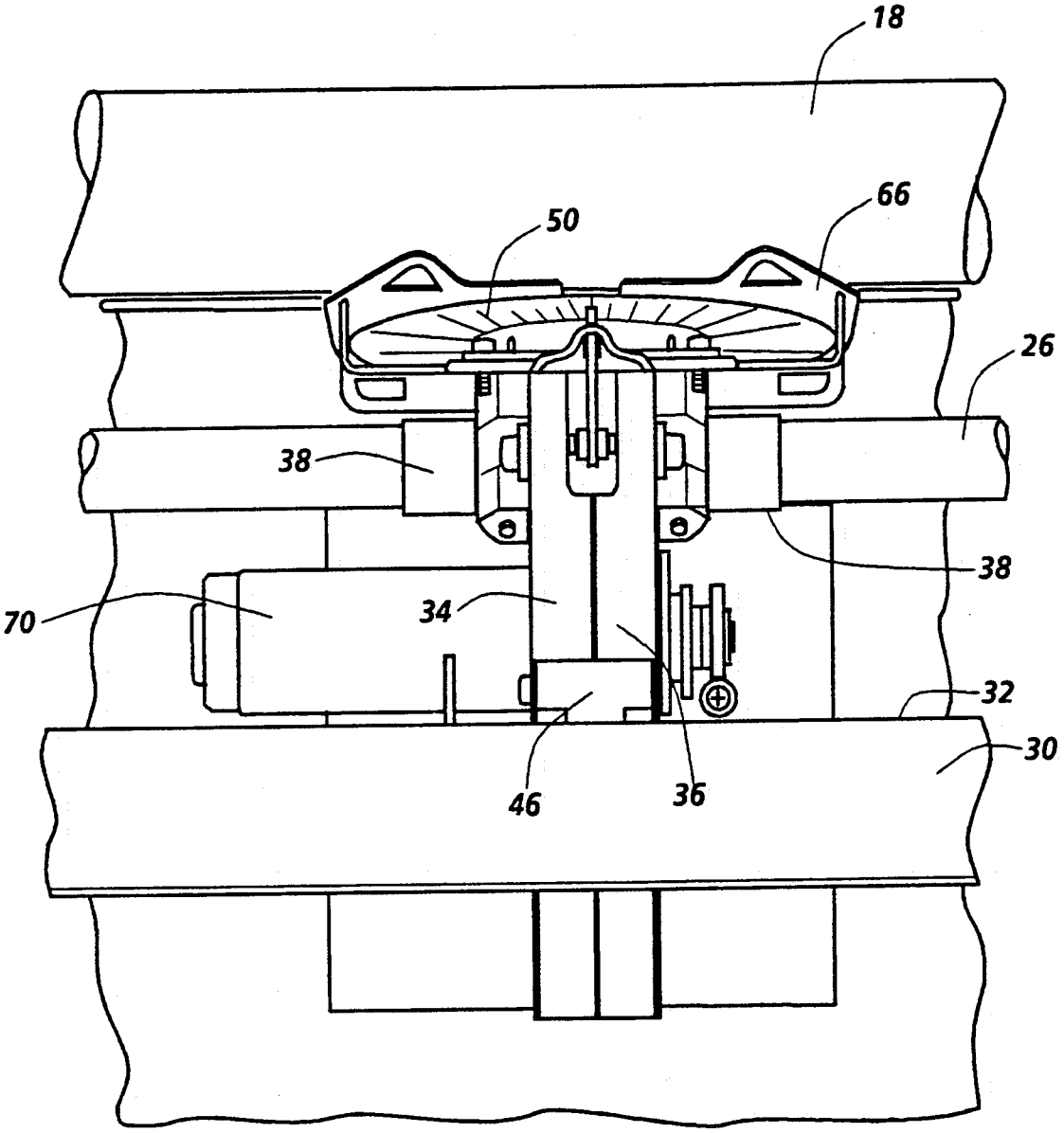
FIG. 2 is a schematic partial plan view looking upon the carriage.
Figure 3:
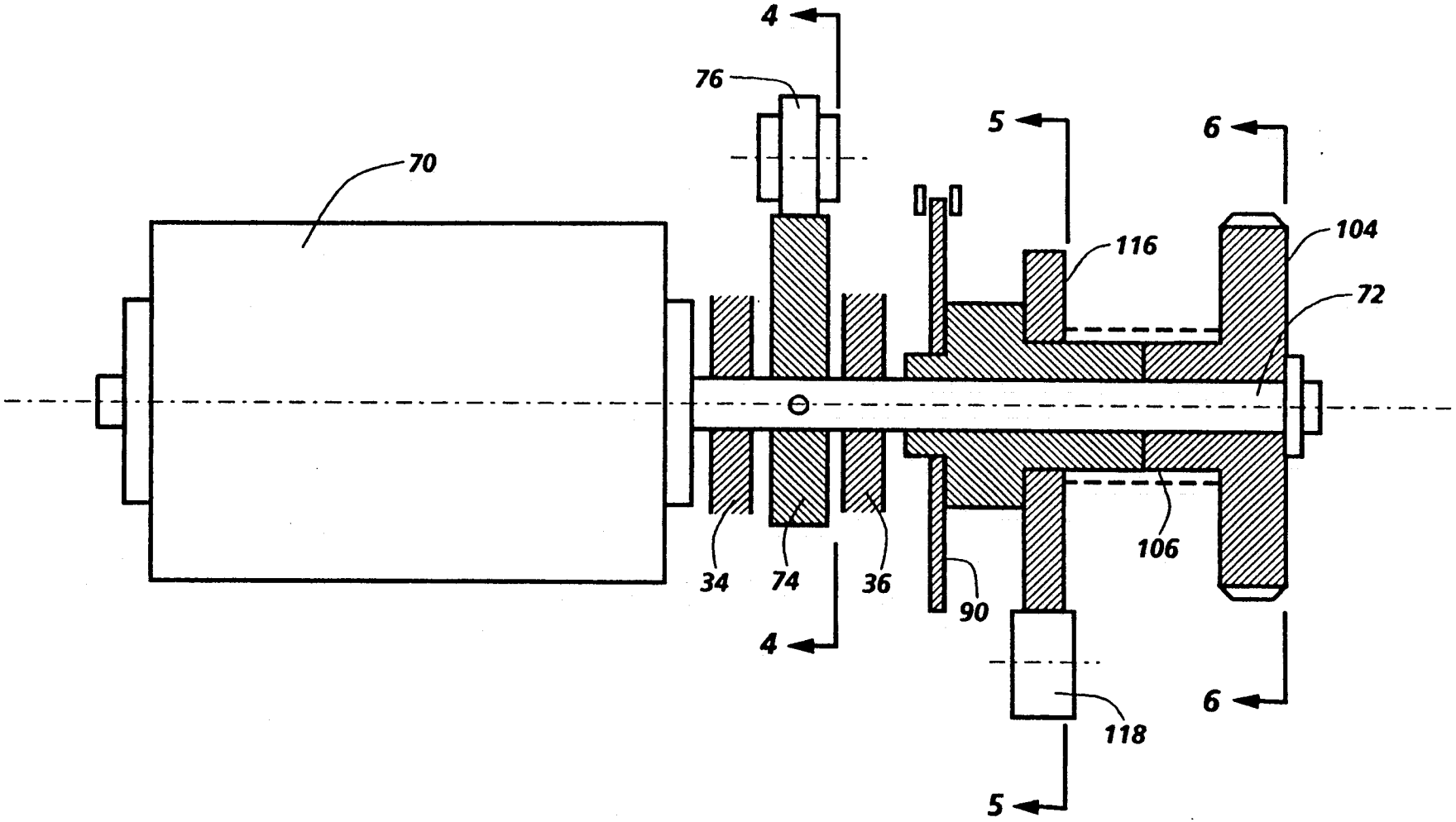
FIG. 3 is a schematic side elevation view showing the D.C. motor, its drive shaft and the hammer and ribbon drive elements thereon.

The salient features of the novel, low cost quiet impact printer 10 of the present invention will now be described with reference to the drawings. An enclosure (only the base 12 is shown) houses its relatively few moving parts. Vertically upstanding left and right side plates 14 and 16 are each secured to the base and support platen 18 therebetween, for rotation in seats therein. The platen is driven by a suitable motor (not shown) through a gear train including driving gear 20 and driven gear 22 on the platen shaft 24. The side plates also support the ends of a highly polished guide rod 26 and the ends of reaction bar 28 having an accurately machined guiding edge 30. The reaction bar is mounted so as to be adjusted to insure that its guiding edge is parallel to the platen surface.

A printer carriage 32 comprised of carriage frame plates 34 and 36 each having a bearing 38 mounted thereon is supported upon the guide rod 26 for reciprocating movement therealong, across the length of the platen. Carriage reciprocating is controlled by a motor (not shown) which drives a toothed spacing belt 40, secured to the carriage, over pulleys 42 and 44. As the carriage 32 moves along the guide rod 26 on bearings 38 it will tend to rotate in a clockwise direction thereabout (as viewed in FIG. 1) under the influence of gravity, and biases bearing shoe 46 against the guiding edge of reaction bar 28. The shoe is made of a hard, low friction material, such as Delrin®. This carriage mounting arrangement facilitates inexpensive assembly of the printing device because it eliminates criticality in the placement of the guide rod, requiring only one element, the reaction bar 28, to be accurately positioned. By adjusting the ends of the reaction bar relative to the side plates 14 and 16, the guiding edge 30 may be accurately positioned parallel to the platen, so that as the carriage 32 traverses the printer all the printing elements carried thereon will be in their proper position relative to the platen.

Figure 4:
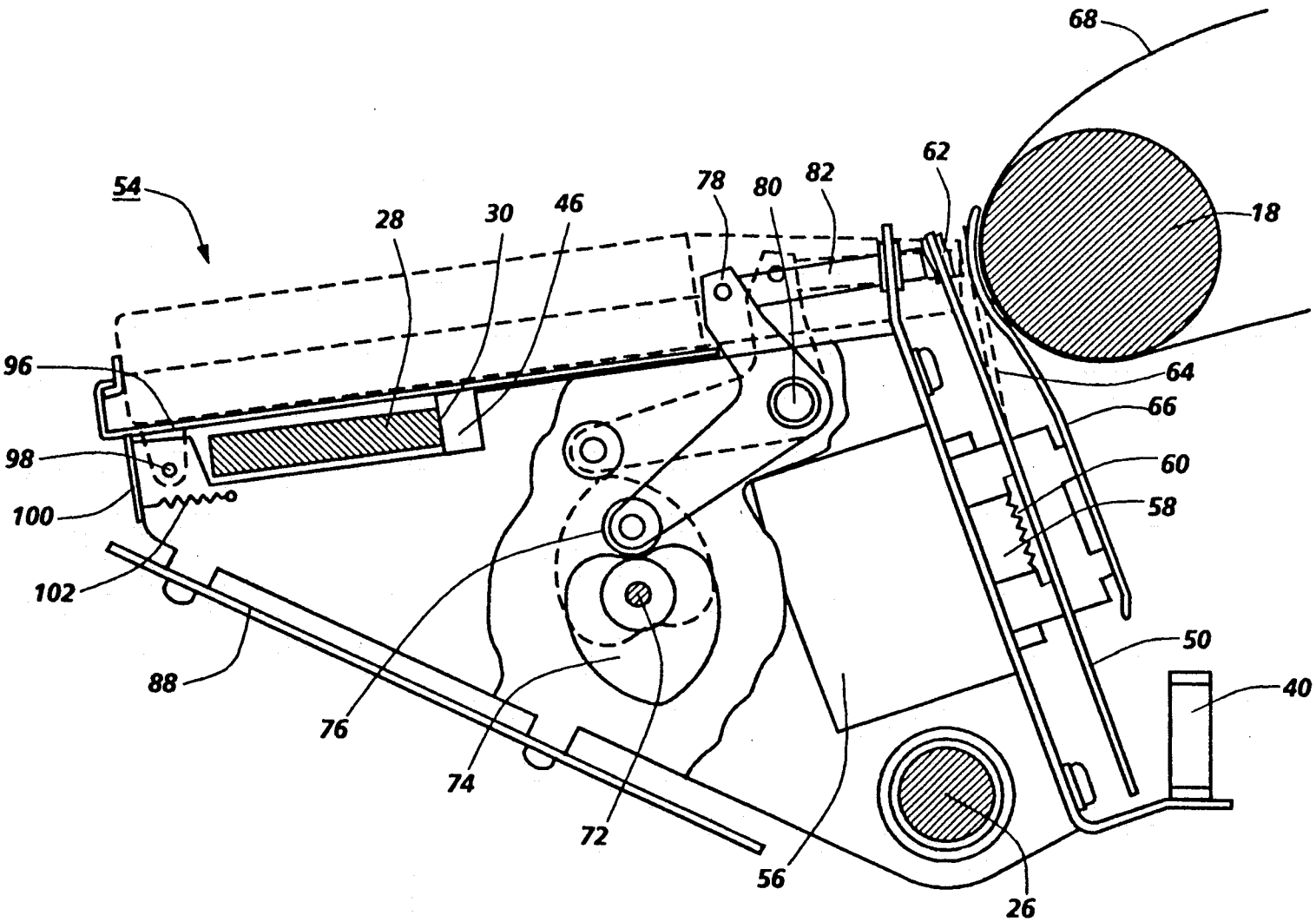
FIG. 4 is a schematic sectional view taken substantially along line 4—4 of FIG. 3 showing the hammer driver.
Figure 5:
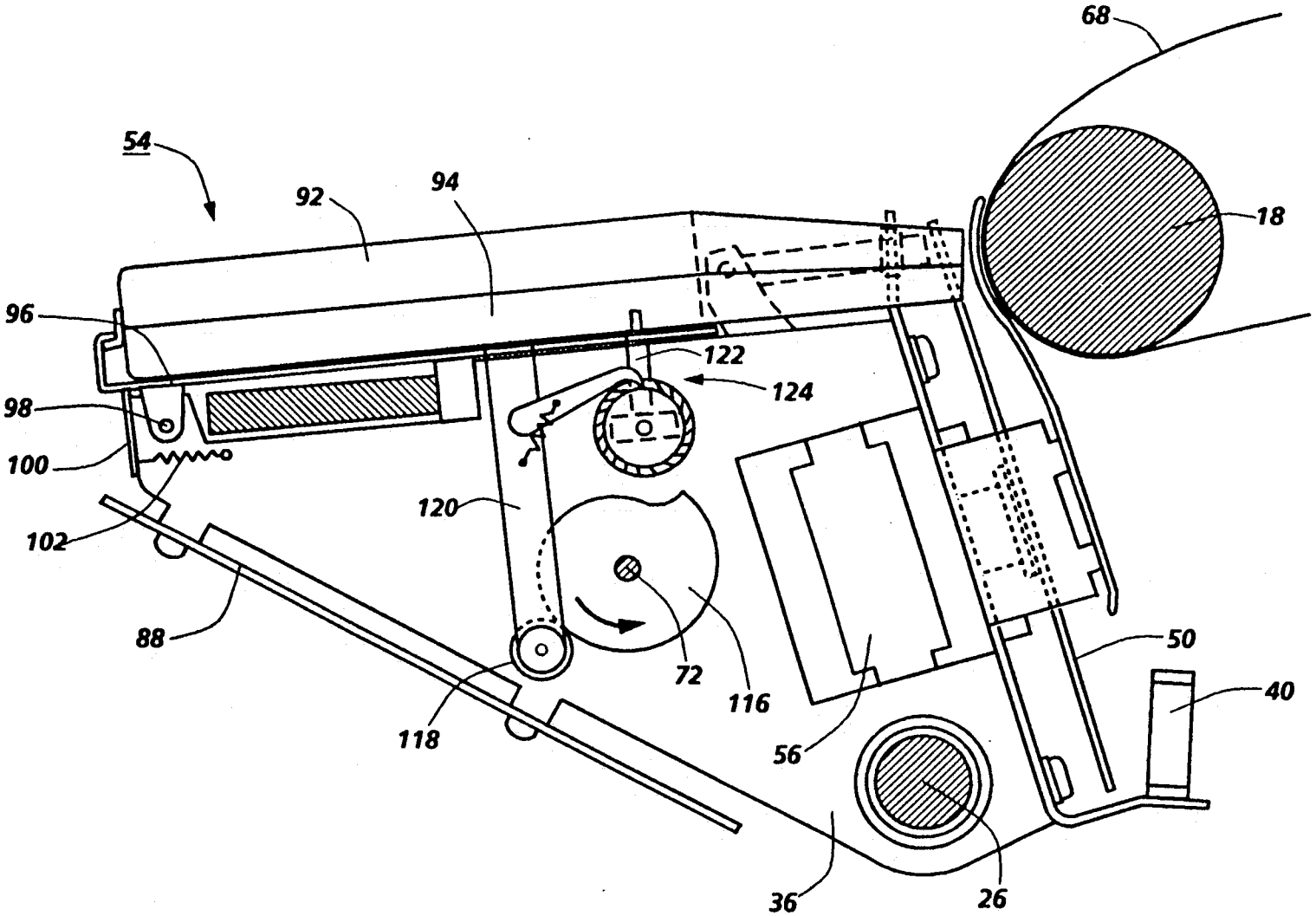
FIG. 5 is a schematic sectional view taken substantially along line 5—5 of FIG. 3 showing the lift-off ribbon driver.
Figure 6:
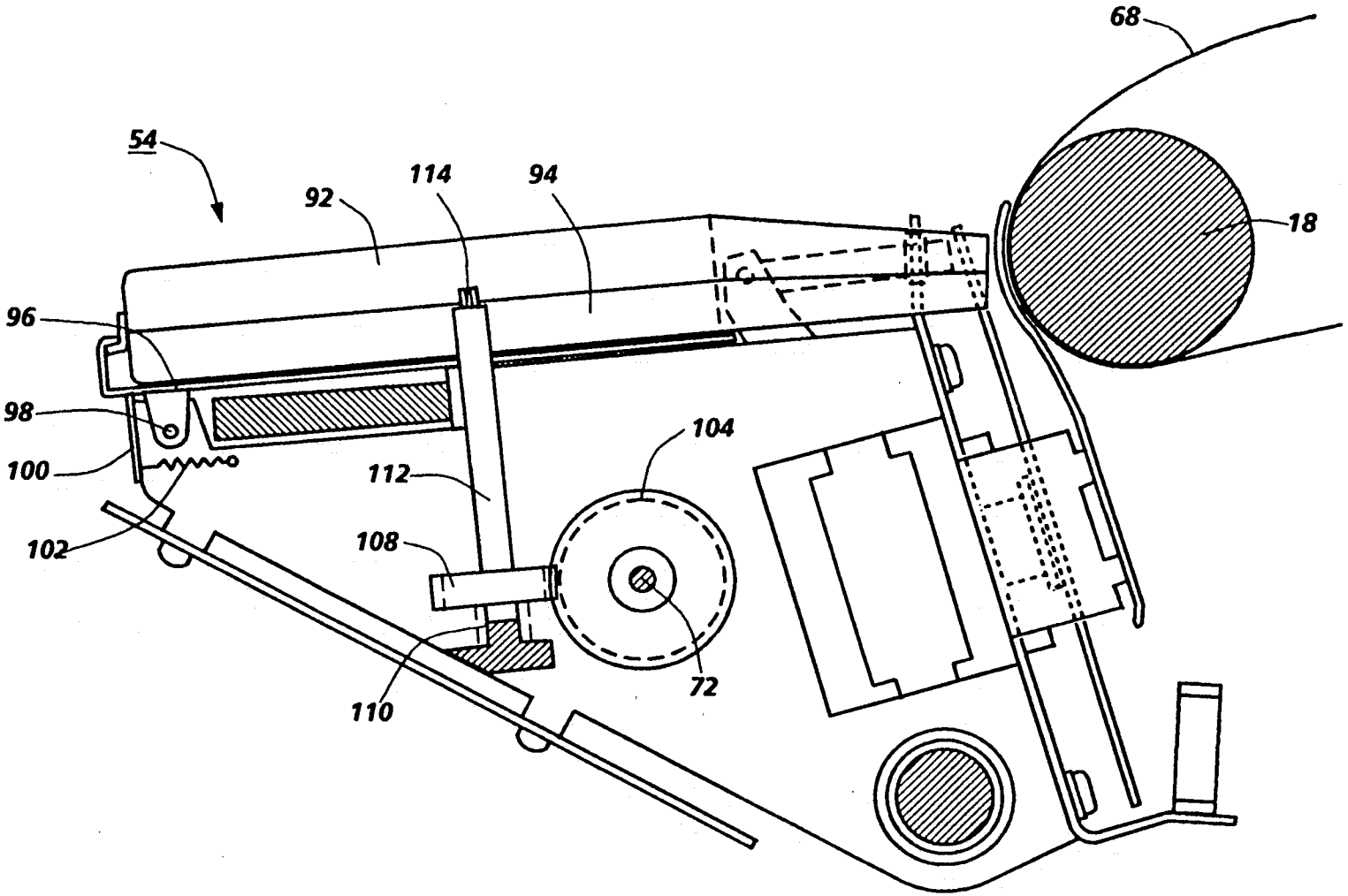
FIG. 6 is a schematic sectional view taken substantially along line 6—6 of FIG. 3 showing the ink ribbon driver.

The printing elements comprise a printwheel 50, a hammer assembly 52 and a ribbon pack assembly 54 (seen in FIGS. 4 and 5). A printwheel drive motor 56 mounted on the carriage frame plates 34 and 36 has a drive coupling 58 to which a printwheel hub 60 may be connected for rotation of the character pads 62 (located at the ends of printwheel spokes 64) past a print station adjacent to the platen. Selective rotation of the drive motor 56 under processor control, initiated by keystrokes, locates and arrests the desired character pad 62 at the print station. A resilient card guide 66 also mounted on the carriage frame plates holds an image receptor sheet 68 in intimate contact with the platen surface.

The hammer assembly 52 is best seen in FIG. 4 wherein carriage frame plate 34 has been cut away to better reveal it. A hammer actuating D.C. motor 70 is mounted upon carriage frame plate 36 with its drive shaft 72 extending through and beyond both frame plates. Drive cam 74 secured to the shaft moves cam follower 76 to rotate bell crank 78, upon which it is carried, about pivot pin 80. The hammer 82 is pinned at the opposite end of the bell crank and slides through a stationary guide bearing 84. As the cam rotation is effected in a predetermined controller manner by the D.C. motor, in response to signals received from the controller 86, mounted upon circuit board 88 secured to the carriage, the hammer is moved toward and away from the platen. In addition to rotating the cam 74, the motor 70 rotates a timing disc 90 which may be in the form of a simple optical encoder capable of generating displacement and direction outputs for sending positioning information back to the controller. The controller uses this information to keep track of the instantaneous hammer position, as well as to derive system velocity.

Small D.C. motors of the type employed in this invention are in widespread use in small appliances. Consequently they are inexpensive and readily available from many sources. Most importantly, however, D.C. motors have characteristics particularly desirable for the application of the hammer force required in the present invention. Namely, they achieve high speeds under light load and produce large torques at low speeds. In the present application, the motor can initially rapidly move the hammer to close the throat between the hammer "home" position and the initiation of platen deformation and subsequently apply the necessary torque to control the deformation force after contact has been made. Furthermore, contact may be determined easily by sensing a sudden decrease in velocity of the motor. Motor motion can be controlled with a simple feedback system under processor control based upon the position, speed and direction of timing disc 90.

Figure 7:
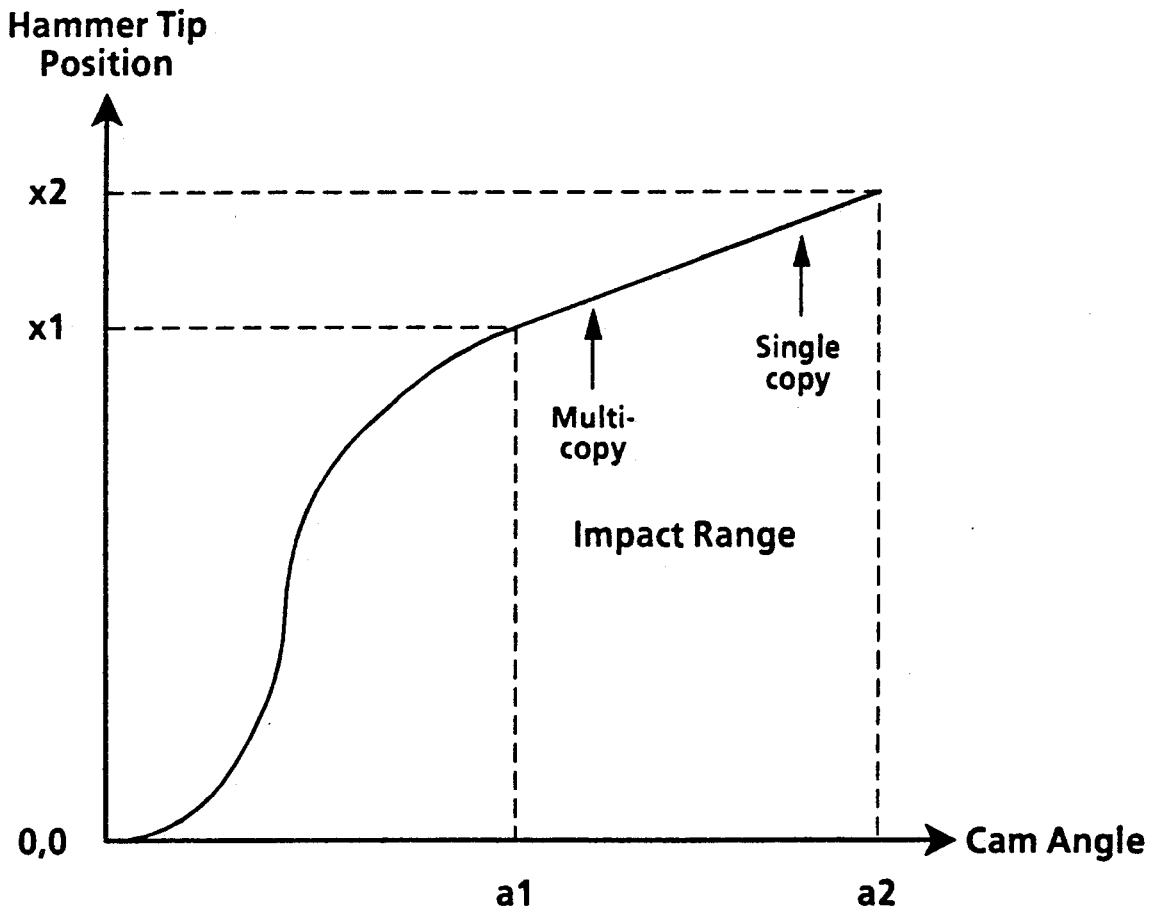
FIG. 7 is a graphical representation of the hammer cam transfer characteristics.

In order to achieve low impact noise the hammer must initiate contact at a very slow velocity but in order to achieve a satisfactory printing speed it must move rapidly across the throat. These movement characteristics are determined by the cam profile and the D.C. motor rotational speed as determined by the controller 86. A representation of the cam displacement characteristics can be seen in FIG. 7. A first cam region will result in the illustrated sinusoidal hammer displacement. Harmonic motion has been selected in order to move the hammer smoothly so as to minimize acoustic noise and component wear. A second cam region will result in the shallow straight line displacement (e.g. 0.001 inch/degree of motor rotation). The straight line cam region should overlap the range in which impact is expected, i.e. from the surface of a multi-sheet pile ($x_1$) to the surface of a single sheet ($x_2$). To this end, the guiding edge 30 of reaction bar 28 must be adjusted toward or away from the platen surface so that the $x_1-x_2$ displacement range of the drive cam 74 corresponds with those receptor sheet conditions. The linearity of this second region results in a linear relationship between the motor current and the hammer force so that its slope is selected to yield the maximum force needed for a particular system in view of the torque available from the motor. The print force is resolved as the hammer 82 is driven against the platen and the shoe 46 is driven against the reaction bar 28. The presence of the reaction bar transforms the hammer into a high effective mass at the moment of impact, enabling the high print force to be obtained at the slow hammer speed. Ideally, if the hammer and the reaction bar were aligned the print force and the reaction force would be equal and opposite and no other system elements would experience and force at impact. However, in view of design constraints it is often not possible to align these forces, in which case there will be a force through the carriage and other elements of the system, including the guide rod 26, all of which should be minimized.

As illustrated in FIGS. 4 and 5, the ribbon pack assembly 54, comprising an marking ribbon cartridge 92 and a lift-off ribbon cartridge 94, may be removably mounted upon a ribbon deck 96 secured atop the carriage frame plates so as to pivot about pivot pin 98. An arm 100 depending from the deck is connected to the frame plates via spring 102 which urges the deck in a counterclockwise direction (as viewed in FIG. 5) about pivot pin 98 for raising the lift-off ribbon to the print position. The marking ribbon and lift-off ribbon each housed within its respective cartridge each may be selectively positioned in front of the hammer, at the print position, and advanced by the single D.C. motor 70. One such arrangement is schematically illustrated.

For advancing the marking ribbon, a driving worm gear 104 is mounted upon motor drive shaft 72 through a one-way clutch 106 for turning driven worm gear 108, also mounted for rotation through a carriage mounted one-way clutch 110. Thus, the worm gears can only move in one direction of motor shaft rotation. When the worm gears are rotated they drive a marking ribbon drive capstan 112 terminating in a cruciform key 114. The key is received in a mating slot in the marking ribbon cartridge for advancing the marking ribbon in a known manner.

The lift-off ribbon is carried below the marking ribbon and is positioned at the printing station when the ribbon deck 96 is pivoted upwardly. Since the ribbon deck 96 is normally urged in its upward position by spring 102 it is necessary to provide means for normally holding it in its lower, printing position. This is accomplished by the ribbon deck positioning cam 116, also secured to the motor drive shaft 72, in combination with cam follower 118 secured at the end of arm 120 depending from the ribbon deck. In its "home" position, the deck positioning cam draws the deck downwardly. When it is desired to lift the deck in order to effect correction, the deck positioning cam 116 is rotated from its home position to allow spring 102 to pivot the deck upwardly. By allowing the deck to be lifted by the spring, rather that utilizing the motor to simultaneously lift the deck and to move the hammer, power requirements are minimized and a smaller, less expensive, motor may be used. Each time the deck is pivoted upwardly the lift-off ribbon is incrementally advanced by a capstan 122 driven off the depending arm 120 by a conventional advancing mechanism, such as a ratchet and pawl arrangement 124.

Figure 8A:
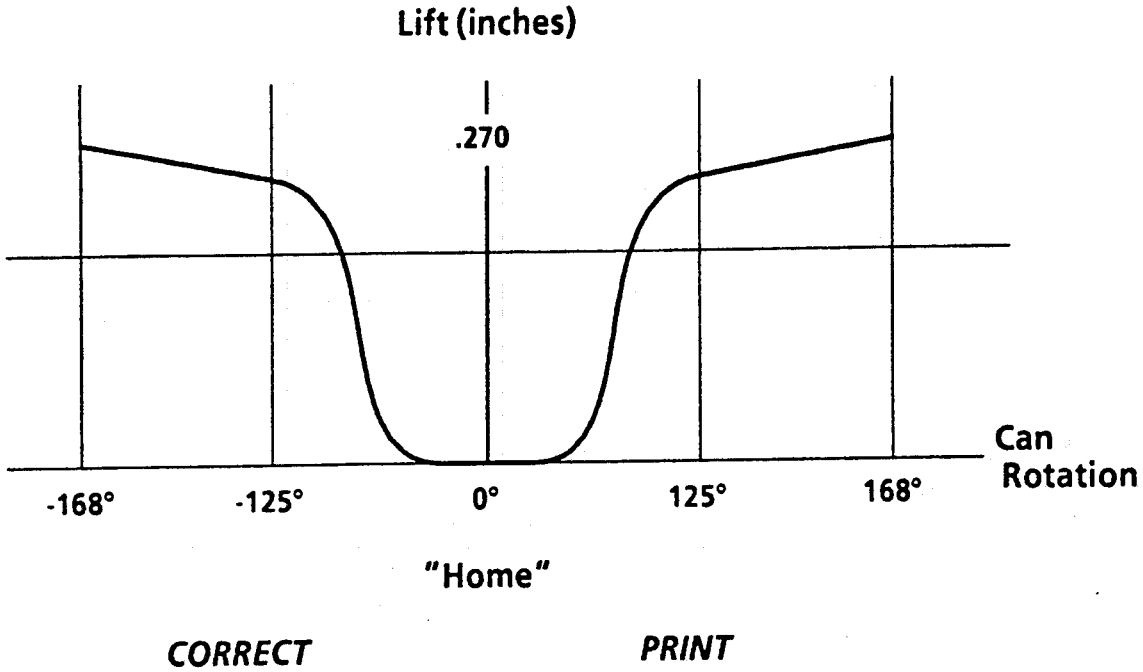
FIG. 8A is a graphical representation of the hammer cam transfer characteristics for a cam capable of use with a a correcting cartridge.
Figure 8B:
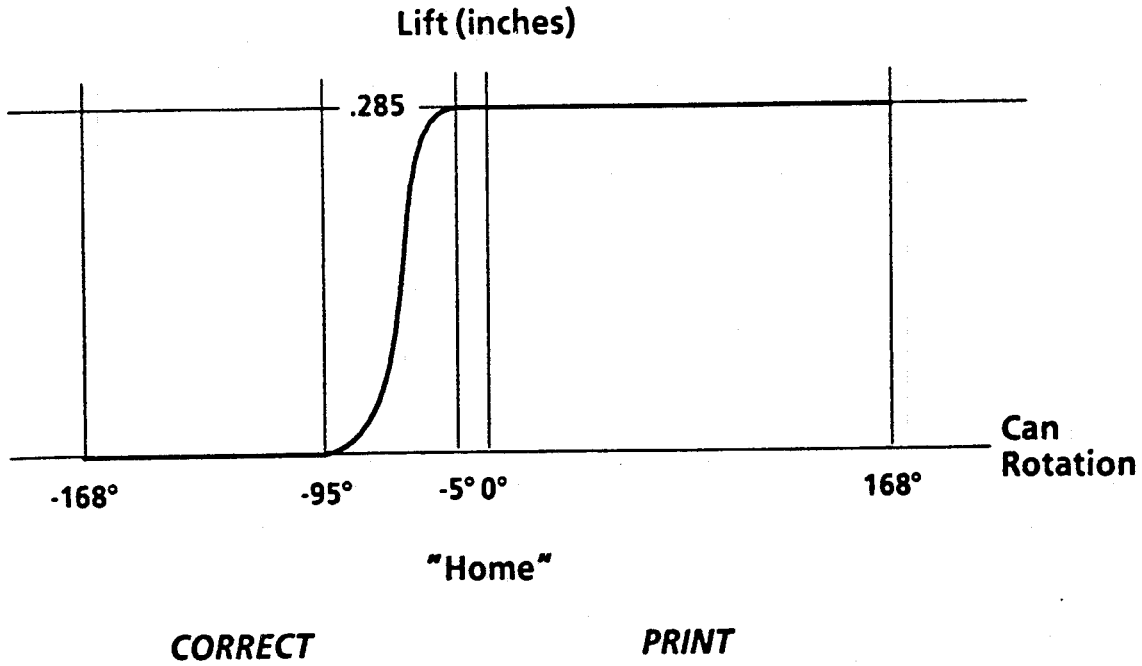
FIG. 8B is a graphical representation of the ribbon cartridge deck lift cam transfer characteristics.

By designing the total maximum cam rotation for the hammer cycle to be less than 180°, the hammer drive cam 74 may be in the form of a mirror image, as shown. Rotation from a home position, in both the clockwise and counterclockwise directions, will drive the hammer similarly. As illustrated in FIG. 8A, the hammer drive cam 74 would be rotated to about 170° and back (from its "home" position) for the normal printing cycle, during which the hammer is driven and the one way clutches 106 and 110 allow the marking ribbon to be advanced. When correction is desired, motor rotates the drive cam 74 to about −170° and back (from its "home" position). Rotation in this sense does not drive the marking ribbon advancing capstan but it does rotate the deck positioning cam 116 (as shown in FIG. 8B) to allow the spring 102 to raise the ribbon deck 96 for positioning the lift-off ribbon at the printing zone. Additionally, it advances the lift-off ribbon as set forth above.

Figure 9:
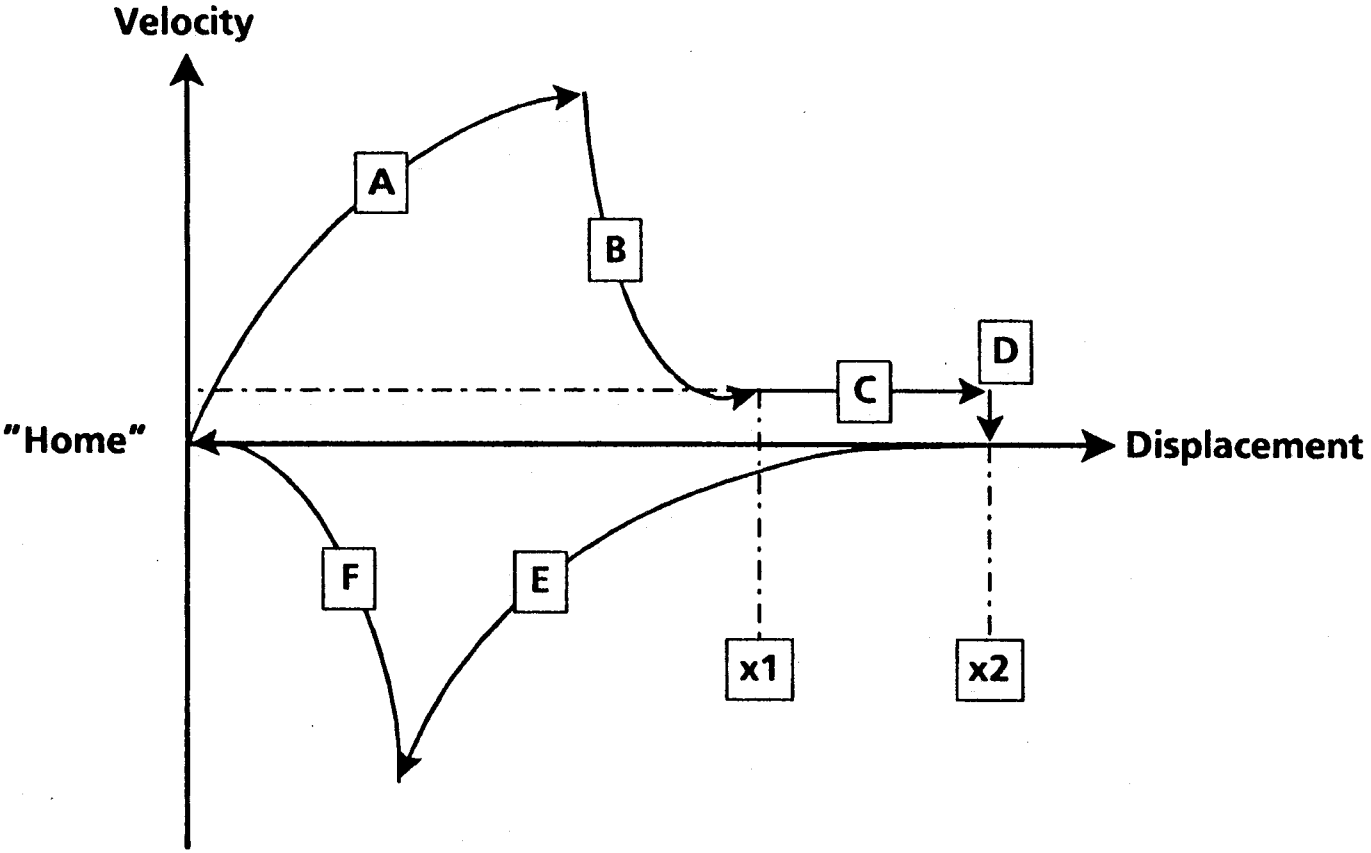
FIG. 9 is a state diagram showing a typical print cycle for this device.

Turning to FIG. 9 there is illustrated a state diagram showing a typical print cycle for this device wherein hammer velocity is plotted against its displacement from its "home" position.

In Acceleration State A the hammer is accelerated forward for approximately half the distance to the expected impact point by applying a controlled current to the D.C. motor.

In Deceleration State B the hammer is decelerated toward point $x_1$ (the beginning of the straight portion of the transfer characteristic) by applying a reverse voltage to the D.C. motor until the velocity reaches a predetermined slow approach velocity of about one to two inches per second.

In Approach State C the hammer approaches the platen under the controlled slow velocity until impact occurs which is signified by and sensed as a sudden change in velocity.

During Deformation State D a constant current is applied to the motor to generate a fixed deformation force, wherein the magnitude of the impression current depends upon the force required to print the selected character.

After printing of the character, Return State E is effected during which the D.C. motor is accelerated in reverse for approximately one-half the distance to the "home" position.

Finally, in Deceleration State F the hammer is decelerated by applying a reverse potential until it is near its "home" position, followed by a dynamic braking to settle the hammer at its "home" position.

As each character is printed in the above-described manner the cam location of the hammer impact position at the end of Approach State C is updated in memory. During the next subsequent cycle this updated information is used to calculate a new deceleration initiation point. Controlled in this manner, the system provides an automatic "rolling" compensation along the axial length of the platen for overcoming mechanical variations in the distance from the hammer "home" position to the platen surface, such as platen skew, platen eccentricity, paper stock thickness, etc.. An initialization cycle may be implemented prior to the initial print cycle in order to establish memory values. Alternatively, initialization default values may be used based upon the assumption that impact will occur at a minimum position. Then in each subsequent cycle the control algorithm adjusts the braking point so as to minimize the duration of the slow Approach State C.

It should be understood that the present disclosure has been made only be way of example and that numerous changes in details of construction and the combination and arrangement of parts mmay be resorted to without departing fromm the true spirit and scope of the invention as hereinafter claimed.

What is claimed:

1. A serial impact printer comprising a support frame, a platen mounted for rotation upon said support frame, a print element having character imprinting portions disposed thereon, a print element selector for moving said print element to position a selected character imprinting portion at a printing position, a marking ribbon and a lift-off ribbon, each ribbon being selectively positionable between said print element and said platen, a hammer for moving a selected character imprinting portion for deforming said platen with a printing force, means for moving said hammer toward and away from said platen, and a carriage mounted for reciprocating movement generally parallel to said platen, said carriage supporting thereon said print element, said print element selector, said marking and lift-off ribbons, means for positioning said ribbons, means for advancing said marking ribbon, means for advancing said liftoff ribbon, said hammer, and said means for moving said hammer, the improvement comprising said means for moving said hammer, said means for positioning said ribbons, said means for advancing said marking ribbon, and said means for advancing said lift-off ribbon includes a single D.C. motor which drives said hammer in both clockwise and in counterclockwise directions of rotation from a home positions, which positions and drives said means for advancing said marking ribbon in only one direction of rotation of said motor from said home position, and which positions and drives said lift-off ribbon in only the opposite direction of rotation of said motor from said home position, whereby at each hammer impact one of said ribbons is being impacted.

2. The serial impact printer as defined in claim 1 wherein said means for moving said hammer further includes a mirror image cam for driving said hammer.

3. The serial impact printer as defined in claim 1 wherein said means for positioning said ribbons comprises a ribbon deck pivotally mounted upon said carriage for supporting said marking and lift-off ribbons thereon, one atop the other, and means for pivoting said deck upward and downward relative to said platen for selectively locating one of said ribbons at said printing position.

4. The serial impact printer as defined in claim 3 wherein said means for moving said hammer further includes a mirror image cam for driving said hammer.

5. The serial impact printer as defined in claim 3 including means for biasing said ribbon deck in its upward position.

6. The serial impact printer as defined in claim 4 including means for biasing said ribbon deck in its upward position.

7. The serial impact printer as defined in claim 5 wherein said means for positioning said ribbon further comprises a second cam driven by said motor and a cam follower connected to said deck, whereby rotation of said motor in said opposite direction moves said deck in opposition to said means for biasing.

8. The serial impact printer as defined in claim 6 wherein said means for positioning said ribbons further comprises a second cam driven by said motor and a cam follower connected to said deck, whereby rotation of said motor in said opposite direction moves said deck in opposition to said means for biasing.

9. The serial impact printer as defined in claim 7 wherein said means for advancing said lift-off ribbon is actuated as said deck is moved.

10. The serial impact printer as defined in claim 8 wherein said means for advancing said lift-off ribbon is actuated as said deck is moved.

* * * * *